US009303224B2

(12) United States Patent
Gutewort

(10) Patent No.: US 9,303,224 B2
(45) Date of Patent: Apr. 5, 2016

(54) TERT-BUTYL HYDROPEROXIDE (TBHP) AS A DIESEL ADDITIVE

(71) Applicant: UNITED INITIATORS GMBH & CO. KG, Pullach (DE)

(72) Inventor: Sven Gutewort, Stockdorf (DE)

(73) Assignee: UNITED INITIATORS GMBH & CO. KG, Pullach (DE)

( * ) Notice: Subject to any disclaimer, the term of this patent is extended or adjusted under 35 U.S.C. 154(b) by 1 day.

(21) Appl. No.: 14/358,831

(22) PCT Filed: Nov. 16, 2012

(86) PCT No.: PCT/EP2012/072877

§ 371 (c)(1),
(2) Date: May 16, 2014

(87) PCT Pub. No.: WO2013/072478

PCT Pub. Date: May 23, 2013

(65) Prior Publication Data

US 2014/0311019 A1 Oct. 23, 2014

(30) Foreign Application Priority Data

Nov. 16, 2011 (EP) ..... 11189416

(51) Int. Cl.

| | |
|---|---|
| ***C10L 1/18*** | (2006.01) |
| ***C10L 1/14*** | (2006.01) |
| ***C10L 10/02*** | (2006.01) |
| ***C10L 10/12*** | (2006.01) |
| *C10L 1/182* | (2006.01) |
| *C10L 1/23* | (2006.01) |

(52) U.S. Cl.

CPC ..... *C10L 1/1811* (2013.01); *C10L 1/14* (2013.01); *C10L 1/18* (2013.01); *C10L 10/02* (2013.01); *C10L 10/12* (2013.01); *C10L 1/1824* (2013.01); *C10L 1/231* (2013.01); *C10L 2270/026* (2013.01)

(58) Field of Classification Search

CPC ..... C10L 1/1811
USPC ..... 44/322, 451, 324
See application file for complete search history.

(56) References Cited

U.S. PATENT DOCUMENTS

| | | | | |
|---|---|---|---|---|
| 2,618,538 | A | 11/1952 | Jones et al. | |
| 2,763,537 | A | 9/1956 | Barusch et al. | |
| 2,912,313 | A | 11/1959 | Hinkamp et al. | |
| 4,104,036 | A | 8/1978 | Chao et al. | |
| 4,289,501 | A * | 9/1981 | Medcalf | 44/443 |
| 4,294,999 | A | 10/1981 | Grane et al. | |
| 4,800,847 | A * | 1/1989 | Pritchard | 123/1 A |
| 5,104,493 | A | 4/1992 | Chong | |
| 5,147,884 | A * | 9/1992 | Diehl et al. | 514/365 |
| 5,669,938 | A * | 9/1997 | Schwab | 44/301 |
| 6,190,427 | B1 | 2/2001 | Ahmed | |
| 7,014,668 | B2 * | 3/2006 | Golubkov et al. | 44/438 |
| 8,621,843 | B2 * | 1/2014 | Xu et al. | 60/274 |
| 8,920,633 | B2 * | 12/2014 | Chan et al. | 208/133 |
| 2010/0088949 | A1 | 4/2010 | Reed | |

FOREIGN PATENT DOCUMENTS

| | | |
|---|---|---|
| CN | 1900240 | 1/2007 |
| CN | 101319147 | 12/2008 |
| DE | 2855860 | 12/1979 |
| EP | 421034 | 4/1991 |
| GB | 628347 | 8/1949 |
| WO | 9324593 | 12/1993 |
| WO | 9407854 | 4/1994 |
| WO | 9921942 | 5/1999 |

OTHER PUBLICATIONS

International Application No. PCT/EP2012/072877, International Search Report dated Mar. 4, 2013.
Machine translation of CN101319147, translated on May 5, 2015.

* cited by examiner

*Primary Examiner* — Ellen McAvoy
(74) *Attorney, Agent, or Firm* — Kilpatrick Townsend & Stockton LLP

(57) ABSTRACT

The present invention relates to the use of TBHP as a fuel additive and in particular as an additive to diesel fuel.

13 Claims, No Drawings

TERT-BUTYL HYDROPEROXIDE (TBHP) AS A DIESEL ADDITIVE

PRIOR RELATED APPLICATIONS

This application is a National Phase application of International Application No. PCT/EP2012/072877, filed Nov. 16, 2012, which claims priority to European Patent Application No. 11189416.8, filed Nov. 16, 2011, each of which is incorporated herein by reference in its entirety.

The present invention relates to the use of tert-butyl hydroperoxide (TBHP) and blends thereof as a fuel additive and in particular as an additive to diesel fuels.

The cetane number is a characteristic parameter for the combustion quality of diesel fuel. The cetane number is a measure of the ease of ignition or the ignition delay, that is to say the time between the start of fuel injection and the start of combustion. Rapid ignition followed by combustion that is uniform and as complete as possible is advantageous. The higher the cetane number, the shorter the ignition delay and the better the combustion quality.

Various additives are used to increase the cetane number. On a commercial scale, 2-EHN (2-ethylhexyl nitrate) is currently used almost exclusively. Problems with this additive are its high toxicity, its poor storage stability, safety-critical properties, and considerable additional costs. The use of 2-EHN is problematic on account of its explosiveness in particular. Furthermore, the nitrogen content can lead to high, undesirable NOX emissions.

Additives that increase the cetane number are also described in U.S. Pat. No. 2,763,537, for example, including alkyl nitrates, nitrites, nitroso compounds, diazo compounds and organic peroxides. With the exception of small amounts of DTBP (di-tert-butyl peroxide), organic peroxides are currently not used commercially as diesel additives. This is for reasons of cost, safety and compatibility.

Commercially available peroxide preparations often contain large amounts of water as phlegmatiser, have insufficient thermal or chemical stability, cannot be used commercially as a fuel additive on account of the raw materials or production processes used, or contain aromatic radicals which adversely affect pollutant emission. Peroxides phlegmatised with water are unsuitable as a propellant additive, however, because water does not mix with the propellant but forms a two-phase system.

Organic peroxides are thermally unstable compounds which decompose exothermally with cleavage of the peroxidic oxygen-oxygen bond. Therefore, for the safe handling or safe transport of organic peroxides, they must, for safety considerations, often be phlegmatised or are produced industrially already in dilution.

In that respect, some anhydrous peroxides are not obtainable or are obtainable only with a high technical outlay.

It was an object of the present invention to provide an improved fuel additive, in particular with regard to pollutant emission, effectiveness, handling ability and costs.

The invention therefore relates to a fuel comprising tert-butyl hydroperoxide (TBHP) as an additive. In a preferred embodiment, the invention relates to a fuel comprising tert-butyl hydroperoxide (TBHP) as an additive component in a mixture of TBHP with other organic peroxides, in particular other organic anhydrous peroxides such as, for example, di-tert-butyl peroxide (DTBP).

Surprisingly, it has been found that tert-butyl hydroperoxide, in particular in anhydrous form, is suitable as a fuel additive. By using TBHP as an additive, in particular the cetane number of the fuel is increased and is preferably raised, compared with the base fuel, by a value of at least 2, more preferably at least 3, yet more preferably at least 4 and most preferably at least 5. The cetane number can be determined according to ASTM 0613, for example. An increase in the cetane number is a measure of the improvement of the ease of ignition of the fuel.

It has further been found that, with the same consumption, the pollutant emissions, in particular the hydrocarbon emission and/or the carbon monoxide emission, can be reduced significantly, whereby at the same time the NOx emission is not raised considerably.

These advantages are obtained in vehicles without a catalyst, but surprisingly also in vehicles with a catalyst.

Surprisingly, it has been possible to determine reduced pollutant emissions both before a downstream catalytic converter and after a downstream catalytic converter. A reduction in the pollutant emissions after the catalyst has been found especially in phase 1 (cycles 1 to 4) of the NEDC driving cycle, in which low speeds of up to 50 km/h are driven and in which the catalyst does not yet reach the full operating temperature. In that respect, TBHP, in particular anhydrous TBHP, and blends thereof are of very great interest also in regions in which the catalyst density in existing vehicle fleets is already very high, such as, for example, Europe, because a large number of journeys are made with vehicles in which the catalyst does not reach the full operating temperature. TBHP, in particular anhydrous TBHP, and blends thereof as a fuel additive consequently also reduce pollutant emission, in particular the emission of hydrocarbons and carbon monoxide, irrespectively of the prevalence of catalytic converters.

Even in vehicles that are operated without a catalyst, pollutant emission in phase 1 (cycles 1 to 4) of the NEDC driving cycle is higher than in phase 2 (cycle 5). In phase 1, the reduction of hydrocarbon and carbon monoxide emissions with fuels that comprise TBHP, in particular anhydrous TBHP, as an additive is particularly high. This is the desired effect, especially for short journeys. In principle, the pollutant emissions of, for example, hydrocarbons and carbon monoxide are higher in the case of the combustion of lower-quality propellant grades than in the case of higher-quality propellant grades.

It has now been found, surprisingly, that TBHP as an additive reduces the pollutant emissions of, for example, hydrocarbons and carbon monoxide to a greater extent when using higher-quality diesel grades, such as, for example, a commercial Euro4 diesel, than when using lower-quality diesel grades, such as, for example, a commercial US diesel. In that respect, TBHP is also suitable, for example, especially as a propellant additive for regions in which higher-quality propellant grades are typically used.

Anhydrous TBHP is preferably used according to the invention as a fuel additive. Anhydrous means that the content of water in the TBHP composition is <5 wt. %, in particular <1 wt. %, yet more preferably <0.3 wt. %.

By using anhydrous TBHP, which is miscible with fuel and in particular with diesel propellant, the formation of an undesirable, second aqueous phase is avoided. TBHP is preferably used as an additive in an anhydrous organic solvent. Polar and non-polar solvents can be used. Examples of suitable non-polar solvents are alkyls and in particular aliphatic hydrocarbons, in particular isododecane, isooctane, decane, nonane or/and n-octane or mixtures of different aliphatic compounds. Examples of polar solvents are in particular oxygen-containing solvents, such as, for example, alcohols or/and ethers. Alkyl alcohols are preferably used as solvents, in particular C1-C8-alkyl alcohols, more preferably C2-C6-alkyl alcohols, yet more preferably butanol and most preferably tert-butanol. By using alcohols and in particular tert-butanol, the oxygen content in the fuel additive is increased further, which is desirable and contributes to improving combustion, as a result of the oxygen enrichment, and accordingly to reducing pollutant emission.

Specifically when using a fuel additive comprising TBHP in tert-butanol (TBA), a significant reduction in soot and pollutant emission has been observed.

The amount of TBHP in the additive is preferably at least 10 wt. %, more preferably at least 30 wt. %, yet more preferably at least 40 wt. % and most preferably at least 50 wt. %. Pure TBHP is not preferred for safety considerations. The amount of TBHP in the additive is therefore preferably up to 90 wt. %, more preferably up to 75 wt. % and most preferably up to 60 wt. %. The amount of anhydrous organic solvents, in particular of alcohols and preferably of tert-butanol, is accordingly at least 10 wt. %, more preferably at least 25 wt. % and most preferably at least 40 wt. %, and up to 90 wt. %, more preferably up to 70 wt. % and most preferably up to 50 wt. %.

An additive that comprises from 30 to 70 wt. % TBHP in from 70 to 30 wt. % tert-butanol has been shown to be particularly suitable and accordingly most preferred. An additive that comprises from 50 to 60 wt. % TBHP in from 50 to 40 wt. % tert-butanol is yet more preferred. An additive that comprises 55 wt. % TBHP and 45 wt. % TBA is most preferred. By the phlegmatisation of TBHP in an oxygen-containing solvent, preferably in an alcohol and in particular in tert-butanol, safety during industrial TBHP production, transport and further handling is improved.

Further particularly preferred solvents are ethers and polyethers, particularly preferably aliphatic or cyclic ethers and/or polyethers.

As well as reducing pollutants in the exhaust, phlegmatisation with an oxygen-containing solvent, preferably an alcohol and in particular tert-butyl alcohol, also leads to an increase in the oxygen content of the additive. For example, a mixture of 55 wt. % TBHP and 45 wt. % TBA has an oxygen content of about 29.3 wt. % oxygen, of which about 9.8 wt. % is active oxygen.

The fuel according to the invention can comprise known fuels or propellants as the base fuel, such as, for example, petrol, in particular regular petrol, super grade petrol, etc., diesel fuels such as, for example, diesel, biodiesel or the like, but also very low diesel grades, such as, for example, various marine diesel grades, rape methyl ester, oxymethylene ethers, kerosine or rocket propellant. The fuel, in particular a diesel fuel or kerosine, can be provided, for example, for diesel generators in, for example, motor vehicles, ships or for stationary diesel engines for power generation or also for aircraft or rocket engines.

By means of the additive according to the invention, the ease of ignition of the fuel in particular is increased. Furthermore, the emission of soot and hydrocarbons and carbon monoxide in the combustion engine is reduced significantly, in particular with unchanged or virtually unchanged NOx emission. Particularly preferably, the fuel according to the invention comprises as the base fuel a high-quality diesel which meets Euro4 diesel requirements.

The TBHP used as additive according to the invention is also significantly better to handle from a safety point of view as compared with the additives conventionally used, such as, for example, 2-EHN. By using TBHP in anhydrous form, in particular in an aqueous organic solvent, the formation of two separate phases is avoided and the use of TBHP as a fuel additive is thereby made possible for the first time.

As compared with conventionally used 2-EHN, the combustion is improved by the use according to the invention of TBHP as additive (in particular lower hydrocarbon, carbon monoxide and soot emission). Furthermore, TBHP does not contain nitrogen, so that the problems associated therewith, and in particular the problem of the formation of nitric oxides, are reduced according to the invention. TBHP is furthermore significantly safer than 2-EHN in terms of safety, in particular in relation to decomposition.

A measure of the rate of decomposition and the build up of pressure during the decomposition of a product is the Koenen test. The greater the Koenen value, the more violent the decomposition.

Thus, the Koenen for 2-EHN is 1.0, while the Koenen for a TBHP phlegmatised with TBA is <1.

The energy released in the decomposition of 2-EHN, with $\Delta H=2210$ J/g, is also significantly higher than that of a TBHP/TBA mixture, with $\Delta H=729$ J/g.

In comparison with di-tert-butyl peroxide (DTBP), which is already being used as a fuel additive, TBHP advantageously has a higher flashpoint of 21° C. The flashpoint of DTBP is, for example, significantly lower than that of TBHP and below room temperature at <0° C. Furthermore, the conductivity of DTBP, at <3 pS/m, is extremely low, so that operations of siphoning DTBP are very critical in terms of safety on account of possible charge separations, because such charge separations can generate sufficient ignition energy to ignite DTBP, because DTBP requires only a very small amount of ignition energy of <0.1 mJ. The energy released in the decomposition of DTBP, with $\Delta H=1370$ J/g, is also significantly higher than that of TBHP phlegmatised with TBA, with $\Delta H$ 729 J/g.

In contrast to non-polar DTBP, polar TBHP is conductive (>1000 pS/m) and accordingly such charge separations do not occur, so that TBHP can be handled significantly more safely than DTBP.

According to the invention, the fuel comprises preferably from 0.001 wt. % to 10 wt. %, more preferably from 0.005 wt. % to 5 wt. % and most preferably from 0.01 wt. % to 2 wt. %, TBHP.

According to the invention it has been found that a reduction in the pollutant emission can be achieved even with small amounts of additive. Particularly preferably, the fuel according to the invention therefore comprises up to 0.5 wt. % TBHP, yet more preferably up to 0.25 wt. % TBHP and most preferably up to 0.15 wt. %.

It is also possible according to the invention to combine the TBHP-containing additive according to the invention with other additives. Preference is given, for example, to combination with other peroxides, in particular with other organic peroxides and preferably with other anhydrous organic peroxides, and in particular with di-tert-butyl peroxide (DTBP). Particular preference is given to an additive that comprises TBHP and DTBP. An additive comprising TBHP, DTBP and TBA is most preferred.

Synergistic effects have surprisingly been found for the combination of anhydrous TBHP with DTBP as additive, so that the combination according to the invention of anhydrous TBHP with DTBP leads to a greater reduction of pollutants than can be achieved by comparable amounts of TBHP or DTBP alone.

The weight ratio of TBHP and DTBP is preferably from 10:90 to 90:10, in particular from 20:80 to 80:20 and yet more preferably from 30:70 to 70:30.

The amount of TBHP and DTBP in the additive is preferably at least 10 wt. %, more preferably at least 30 wt. %, yet more preferably at least 40 wt. % and most preferably at least 50 wt. %. Furthermore, the amount of TBHP and DTBP in the additive is preferably up to 90 wt. %, more preferably up to 75 wt. % and most preferably up to 60 wt. %. The amount of anhydrous organic solvents, in particular of alcohols and preferably of tert-butanol, is accordingly at least 10 wt. %, more preferably at least 25 wt. % and most preferably at least 40 wt. %, and up to 90 wt. %, more preferably up to 70 wt. % and most preferably up to 50 wt. %.

The production of TBHP can be carried out by known production processes.

The fuel additive according to the invention comprises in particular anhydrous TBHP and preferably TBHP in an organic solvent. The organic solvent is preferably an alcohol, in particular tert-butanol. Particular preference is given to an additive comprising from 30 to 70 wt. % TBHP in from 70 to 30 wt. % organic solvent, in particular TBA, more preferably from 50 to 60 wt. % TBHP in from 50 to 40 wt. % organic solvent, in particular TBA.

Particular preference is further given to a fuel additive which, as well as comprising TBHP, comprises a further organic peroxide, in particular a further anhydrous organic peroxide. An additive comprising TBHP and DTBP is most preferred. In a particularly preferred embodiment, the peroxides are present in the additive in an alcohol, in particular in TBA.

Preference is further given to a fuel additive which, as well as comprising TBHP, comprises another known fuel additive, such as, for example, 2-EHN. In a particularly preferred embodiment, the TBHP is present in an alcohol, in particular in TBA.

The preferred relative proportions of TBHP, optional further organic peroxide such as, for example, DTBP and organic solvent, in particular TBA, are as described hereinbefore.

It has further been found according to the invention that the pollutant emission can be reduced using the fuel additive according to the invention or a fuel comprising the fuel additive according to the invention. The invention therefore relates also to the use of TBHP for pollutant reduction, in particular for reducing the hydrocarbon emission and/or the carbon monoxide emission. The invention relates particularly preferably to the use of TBHP for reducing pollutant emission in vehicles with a catalyst. The use of an additive comprising TBHP, DTBP and TBA for pollutant emission is most preferred.

The invention relates further to a fuel additive comprising TBHP, in particular as described hereinbefore, and to the use of TBHP or of the fuel additives described herein for increasing the cetane number.

The invention relates further to a fuel additive comprising TBHP, in particular as described hereinbefore, and to the use of TBHP or of the fuel additives described herein for pollutant reduction, in particular for reducing the emission of hydrocarbons or/and carbon monoxide.

The invention will be explained further by means of the following examples.

EXAMPLE 1

Fuel Comprising TBHP as Additive

A conventional US base diesel fuel has a cetane number of 45.2. An additive consisting of 55 wt. % TBHP and 45 wt. % tert-butanol is added to this fuel in a concentration, based on TBHP, of 0.026 wt. % additive amount as well as in a concentration of 0.11 wt. %.

By addition of 0.026 wt. % TBHP, the CETANE number increases from 45.2 to 47.4. With a further addition of 0.11 wt. % TBHP in total, the CETANE number is increased to 50.0.

Comparative emission and consumption measurements were carried out on a roller-type test bench according to the standardised NEDC driving cycle with a conventional US base diesel propellant (cetane number 45.2) and a conventional EU4 base diesel propellant (cetane number 54.6) with and without TBHP additive.

The test vehicle used was a Mercedes C 220 CDI, 4 cylinder, 110 KW power, year of manufacture 2005, with a 5-gear automatic transmission and a kilometer reading of about 140,000 km. The vehicle is equipped with a particle filter and catalyst. The emissions were determined in multiple measurements before and after the catalyst.

By an addition of 0.11 wt. % TBHP to a conventional EU base diesel propellant with a CETANE number of 54.6, it was possible to reduce the crude emissions before the catalyst as follows, the average consumption being unchanged:

| EU4 base diesel | | |
|---|---|---|
| | 0.11 wt. % TBHP | |
| Measured values before the catalyst | Phase 1 (cycles 1-4 NEDC) | Phase 2 (cycle 5 NEDC) |
| Hydrocarbons (HC) | −10.0% | −7.0% |
| Carbon monoxide (CO) | −9.7% | −5.2% |
| Carbon dioxide (CO2) | 0.0% | 0.0% |

The $NO_x$ emissions increase only very slightly by 6.1% in phase 1 and 2.9% in phase 2.

The positive effect of the reduction of emissions in phase 1, the cold-start phase in NECD cycles 1 to 4, is particularly important and pronounced.

| EU4 base diesel | |
|---|---|
| Measured values after the catalyst | 0.11 wt. % TBHP Phase 1 (cycles 1-4 NEDC) |
| Hydrocarbons (HC) | −43.7% |
| Carbon monoxide (CO) | −30.2% |
| Carbon dioxide (CO2) | 0.0% |

By an addition of 0.11 wt. % TBHP to a conventional US base diesel propellant with a cetane number of 45.2, the following crude emissions could be observed before the catalyst, the average consumption being unchanged:

| US base diesel | | |
|---|---|---|
| | 0.11 wt. % TBHP | |
| Measured values before the catalyst | Phase 1 (cycles 1-4 NEDC) | Phase 2 (cycle 5 NEDC) |
| Hydrocarbons (HC) | −8.4% | 0.5% |
| Carbon monoxide (CO) | −8.0% | 4.2% |
| Carbon dioxide (CO2) | 0.0% | 0.0% |

The $NO_x$ emissions increase below the measuring tolerance.

Especially in phase 1 (cycles 1-4 NEDC), a very pronounced reduction in the emissions was measured after the catalyst, because it does not yet have the required operating temperature:

| US base diesel | |
|---|---|
| Measured values after the catalyst | 0.11 wt. % TBHP Phase 1 (cycles 1-4 NEDC) |
| Hydrocarbons (HC) | −17.5% |
| Carbon monoxide (CO) | −16.9% |
| Carbon dioxide (CO2) | 0.0% |

The absolute values of the pollutant emissions, based on hydrocarbons and carbon monoxide, are in any case lower in the case of the commercial EU4 diesel grade than in the case of the commercial US base diesel grade. Nevertheless, with 0.11% TBHP as additive, a greater percentage reduction in pollutant emission could be achieved with the higher-quality commercial EU4 diesel propellant grade than with the US base diesel grade:

| | | Analytical values in each case in mg/kg | | | |
|---|---|---|---|---|---|
| | | before the catalyst | | after the catalyst | |
| Pollutant | Propellant | Phase 1 | Phase 2 | Phase 1 | Phase 2 |
| Hydro-carbons | Euro4 diesel | 431.8 | 334.9 | 77.4 | 10.9 |
| | Euro4 diesel + 0.11 wt. % TBHP | 388.7 | 311.4 | 43.6 | 9.2 |
| | Reduction | 10.0% | 7.0% | 43.7% | 15.9% |
| Carbon monoxide | Euro4 diesel | 799.7 | 461.1 | 199.9 | 5.1 |
| | Euro4 diesel + 0.11 wt. % TBHP | 722.2 | 436.9 | 139.5 | 5.3 |
| | Reduction | 9.7% | 5.2% | 30.2% | −2.8% |
| NOX | Euro4 diesel | 80.8 | 117.4 | | |
| | Euro4 diesel + 0.11 wt. % TBHP | 85.7 | 120.8 | | |
| | Reduction | −6.1% | −2.9% | | |
| Hydro-carbons | US base diesel | 587.4 | 393.8 | 101.6 | |
| | US base diesel + 0.11 wt. % TBHP | 538.2 | 395.7 | 83.8 | |
| | Reduction | 8.4% | −0.5% | 17.5% | |
| Carbon monoxide | US base diesel | 1025.9 | 533.8 | 315.2 | 5.7 |
| | US base diesel + 0.11 wt. % TBHP | 944.2 | 511.4 | 261.9 | 5.7 |
| | Reduction | 8.0% | 4.2% | 16.9% | 0.0% |
| NOX | US base diesel | | | 79.4 | 118.5 |
| | US base diesel + 0.11 wt. % TBHP | 85.4 | 122.0 | 80.6 | 121.3 |
| | Reduction | | | 0.0 | 0.0 |

EXAMPLE 2

Fuel Comprising TBHP and DTBP as Additive

An additive consisting of 27.5 wt. % TBHP, 22.5 wt. % TBA and 50 wt. % DTBP is mixed with a conventional US base diesel fuel.

Mixture 1 contains 0.013 wt. % TBHP and 0.024 wt. % DTBP.

Mixture 2 contains 0.052 wt. % TBHP and 0.094 wt. % DTBP.

The CETANE number of the conventional base diesel propellant is 45.2, that of mixture 1 is 47.9 and that of mixture 2 is 56.7.

In comparison with the base fuel, the cetane number is increased significantly by the addition of the additive and, according to the following table, the pollutant emissions are reduced significantly and especially in phase 1 even more significantly, the consumption being unchanged.

| US base diesel | | |
|---|---|---|
| | 0.052 wt. % TBHP and 0.094 wt. % DTBP | |
| Measured values before the catalyst | Phase 1 (cycles 1-4 NEDC) | Phase 2 (cycle 5 NEDC) |
| Hydrocarbons (HC) | −22.6% | −4.2% |
| Carbon monoxide (CO) | −22.0% | −11.9% |
| Carbon dioxide (CO2) | 0.0% | 0.0% |

Especially in phase 1 (cycles 1-4 NEDC), a very pronounced reduction in the emissions was also measured after the catalyst, because it does not yet have the required operating temperature:

| US base diesel | |
|---|---|
| Measured values after the catalyst | 0.052 wt. % TBHP and 0.094 wt. % DTBP Phase 1 (cycles 1-4 NEDC) |
| Hydrocarbons (HC) | −43.0% |
| Carbon monoxide (CO) | −39.5% |
| Carbon dioxide (CO2) | 0.0% |

The $NO_x$ emissions increase below the measuring tolerance.

The invention claimed is:

1. A fuel comprising anhydrous tert-butyl hydroperoxide (TBHP) as an additive, wherein the additive comprises TBHP in tert-butanol.

2. The fuel of claim 1, wherein the additive comprises from 30 to 70 wt % TBHP in from 70 to 30 wt % organic solvent.

3. The fuel of claim 1, wherein TBHP is present in an amount of from 0.001 wt % to 10 wt % based on the total weight of the fuel.

4. The fuel of claim 1, wherein the fuel is selected from the group consisting of diesel fuel, petrol, rape methyl ester, kerosine and rocket propellants.

5. The fuel of claim 1, wherein the fuel is diesel fuel.

6. The fuel of claim 1, wherein the fuel comprises di-tert-butyl peroxide as a further additive.

7. A fuel additive comprising anhydrous tert-butyl hydroperoxide (TBHP) in tert-butanol.

8. The fuel additive of claim 7, further comprising di-tert-butyl peroxide (DTBP).

9. The fuel additive of claim 7, further comprising 2-ethylhexyl nitrate (2-EHN).

10. A method of increasing cetane number of a fuel, comprising adding to the fuel an additive comprising anhydrous tert-butyl hydroperoxide (TBHP) in tert-butanol to increase the cetane number.

11. The method of claim 10, wherein the additive comprises a mixture of anhydrous TBHP and di-tert-butyl peroxide (DTBP).

12. A method of reducing carbon monoxide emission, hydrocarbon emission or both of a vehicle, comprising running the vehicle on a fuel comprising an additive comprising anhydrous tert-butyl hydroperoxide (TBHP) in tert-butanol.

13. The method of claim 12, wherein the additive comprises a mixture of anhydrous TBHP and di-tert-butyl peroxide (DTBP).

* * * * *